US007963325B2

(12) United States Patent
Johnson et al.

(10) Patent No.: US 7,963,325 B2
(45) Date of Patent: Jun. 21, 2011

(54) METHOD AND SYSTEM FOR FRACTURING SUBSURFACE FORMATIONS DURING THE DRILLING THEREOF

(75) Inventors: Ashley Johnson, Cambridge (GB); Benjamin P. Jeffryes, Cambridge (GB); J. Ernest Brown, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 433 days.

(21) Appl. No.: 11/950,487

(22) Filed: Dec. 5, 2007

(65) Prior Publication Data

US 2009/0145660 A1 Jun. 11, 2009

(51) Int. Cl.
*E21B 43/26* (2006.01)

(52) U.S. Cl. ..... 166/250.1; 166/177.5

(58) Field of Classification Search ..... 166/177.5, 166/250.1, 308.1
See application file for complete search history.

(56) References Cited

U.S. PATENT DOCUMENTS

| | | | | |
|---|---|---|---|---|
| 2,783,026 | A | 2/1957 | Reistle, Jr. | |
| 3,231,031 | A * | 1/1966 | Cleary | 175/67 |
| 3,248,938 | A * | 5/1966 | Hill et al. | 73/152.18 |
| 5,472,049 | A * | 12/1995 | Chaffee et al. | 166/250.1 |
| 5,730,219 | A * | 3/1998 | Tubel et al. | 166/250.1 |
| 6,021,377 | A | 2/2000 | Dubinsky et al. | |
| 6,176,323 | B1 | 1/2001 | Weirich et al. | |
| 6,837,313 | B2 | 1/2005 | Hosie et al. | |
| 7,044,239 | B2 | 5/2006 | Pinckard et al. | |
| 7,174,975 | B2 | 2/2007 | Krueger et al. | |
| 2004/0206494 | A1 * | 10/2004 | Stephenson et al. | 166/250.1 |
| 2005/0230107 | A1 | 10/2005 | McDaniel et al. | |
| 2006/0196664 | A1 | 9/2006 | Hall et al. | |
| 2007/0045006 | A1 | 3/2007 | Krueger et al. | |
| 2009/0095474 | A1 * | 4/2009 | Lesso et al. | 166/281 |
| 2009/0151938 | A1 * | 6/2009 | Conkle et al. | 166/254.1 |

FOREIGN PATENT DOCUMENTS

| | | |
|---|---|---|
| WO | W09842948 | 10/1998 |
| WO | W00250398 | 6/2002 |
| WO | W003048525 | 6/2003 |

* cited by examiner

*Primary Examiner* — David J Bagnell
*Assistant Examiner* — Catherine Loikith
(74) *Attorney, Agent, or Firm* — David J. Smith; Dave R. Hofman

(57) ABSTRACT

A method for fracturing a wellbore while drilling a wellbore includes inserting a drill string into a wellbore. A fluid is pumped into at least one of an interior passage in the drill string and an annular space between a wall of the wellbore and the drill string. At least one of a pressure and a temperature of the fluid proximate a lower end of the drill string is measured and the measurements are transmitted to the surface substantially contemporaneously with the measuring. At least one of a flow rate and a pressure of the fluid is controlled in response to the measurements to selectively create fractures in formations adjacent to the wellbore.

10 Claims, 3 Drawing Sheets

METHOD AND SYSTEM FOR FRACTURING SUBSURFACE FORMATIONS DURING THE DRILLING THEREOF

BACKGROUND OF THE INVENTION

1. Field of the Invention

The invention relates generally to the field of drilling wellbores through subsurface Earth formations. More specifically, the invention relates to methods and systems for creating fractures in Earth formations during the process of drilling such formations.

2. Background Art

Wellbores are drilled through subsurface Earth formations, for among other purposes to extract useful fluids such as petroleum. A wellbore provides an hydraulically conductive path from a permeable, fluid-bearing subsurface formation to the Earth's surface, such that fluids present in the pore spaces of such formations may be moved to the surface through the wellbore.

Certain types of subsurface formations may be susceptible to reduction in their permeability near the wellbore as a result of the drilling of the wellbore. Such reduction in permeability is known as "skin damage" and may result in the particular wellbore producing substantially less fluid and/or at substantially lower flow rates than would have been predicted based on the fluid flow properties of the particular formation. Other subsurface formations have relatively low natural permeability. For circumstances as explained above, among others it is known in the art to hydraulically fracture such subsurface formations. Hydraulic fracturing typically includes pumping fluid into the formation at rates sufficient to create pressures that exceed the pressure at which the formation will break or rupture. Once a fracture is initiated, pumping of fluid may continue for a selected period of time so that the fracture will extend a selected lateral distance from the wellbore. When the fluid pumping stops, however, the weigh of the formations above the fractured formation would cause the fracture to close. Fracture fluids known in the art therefore include a suspension of various solid particles called "proppant" that resist crushing and consequent closing of a fracture after pumping stops. The effect of the fracture is to increase the effective radius of the wellbore. As is known in the art, the rate at which fluid flows from a subsurface reservoir is related to, among other factors, the ratio of the wellbore radius with respect to the subsurface reservoir radius.

The above fracturing procedures are typically performed after drilling a wellbore is completes and a protective pipe or casing is placed in the wellbore. There may be substantial savings of time and cost if fracturing were performed during the drilling of a wellbore, so that particular subsurface formations could be evaluated earlier in the well construction process.

SUMMARY OF THE INVENTION

A method for fracturing a wellbore while drilling according to one aspect of the invention includes inserting a drill string into a wellbore. A fluid is pumped into at least one of an interior passage in the drill string and an annular space between a wall of the wellbore and the drill string. At least one of a pressure and a temperature of the fluid proximate a lower end of the drill string is measured and the measurements are transmitted to the surface substantially contemporaneously with the measuring. At least one of a flow rate and a pressure of the fluid is controlled in response to the measurements to selectively create fractures in formations adjacent to the wellbore.

A fracturing while drilling system according to another aspect of the invention includes a drill string extendible into a wellbore and having at least one of an optical and an electrical communication channel associated therewith. At least one sensor is disposed near an end of the drill string and is configured to measure a parameter in an annular space between the wellbore and the drill string. The system includes pump configured to automatically adjust the at least one of pressure and flow rate in response to measurements from the at least one sensor.

A fracturing while drilling system according to another aspect of the invention includes a drill string extendible into a wellbore and having at least one of an optical and an electrical communication channel associated therewith. At least one sensor is disposed near an end of the drill string and is configured to measure a parameter in an annular space between the wellbore and the drill string. The system includes means for controlling at least one of a pressure and a rate of flow of a fluid pumped through the drill string. The means for controlling is configured to automatically adjust the at least one of pressure and flow rate in response to measurements from the at least one sensor.

Other aspects and advantages of the invention will be apparent from the following description and the appended claims.

DETAILED DESCRIPTION

Figure 1:
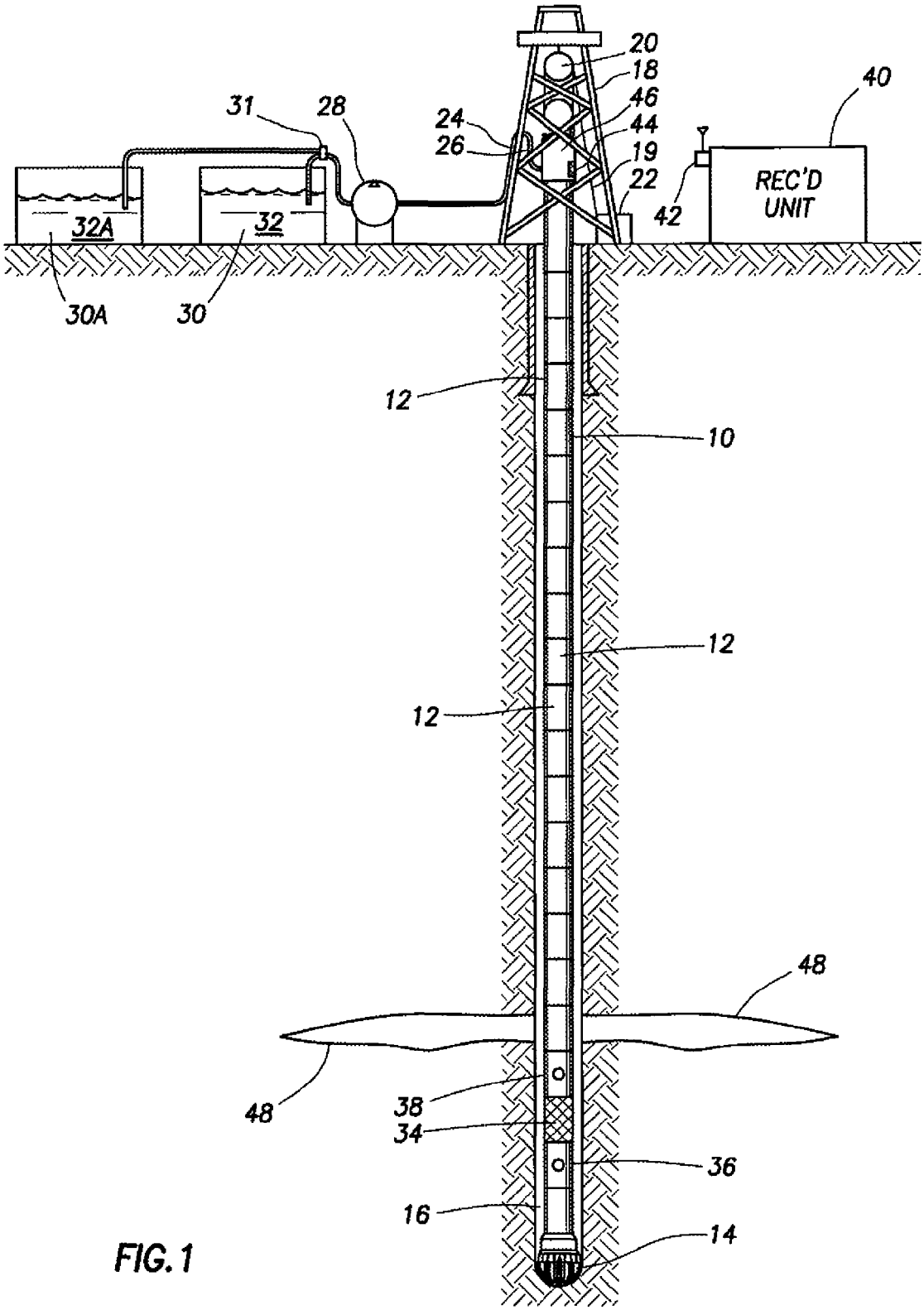
FIG. 1 shows an example of a wellbore being drilled using "wired drill pipe."

An example of a system for drilling a wellbore through the Earth's subsurface is shown schematically in FIG. 1. A drilling rig 18 or similar support structure may be disposed at the Earth's surface. The drilling rig 18 includes equipment such as a drawworks 22, sheaves 20 and a drill line 19 configured to movably support a drill string 10 as it drills subsurface formations. The drill string 10 may be formed from segments 12 ("joints") of "wired drill pipe" threadedly coupled together end to end. "Wired drill pipe" is a drill pipe structure that includes at least one electrical and/or optical conductor for providing a power and/or signal communication channel along the assembled drill string 10. A non-limiting example of a structure for wired drill pipe that may be used in some examples is described in U.S. Patent Application Publication No. 2006/0225926 filed by Madhavan et al.

The drill string 10 typically includes a drill bit 14 at a lower end thereof Rotation of the drill bit 14 and application of axial force to the drill bit 14 by imparting thereto a portion of the weight of the drill string 10 causes the drill bit 14 to crush, chip and/or cut the formations at the longitudinal end (bottom) of the wellbore 16.

The drill string 10 may include various devices, typically proximate the drill bit 14, for measuring properties of the formations surrounding the wellbore 16, for example, logging while drilling ("LWD") sensors 38, for performing certain mechanical functions (e.g. an annular seal or "packer" 34) as will be described in more detail below, and for measuring a parameter (e.g., annular pressure sensor 36) in an annular space between the wall of the wellbore 16 and the exterior of the drill string 10. Control of operation of the foregoing example devices, and communication of the measurements made by the various devices to the surface may be performed using the communication channel in the wired drill pipe string 10. Control signals may be generated, for example, in a recording unit 40 disposed at the Earth's surface. The control signals may be transmitted over a wireless transceiver 42 associated with a recording unit 40 to a corresponding wireless transceiver 44 associated with a top drive 46 suspended in the drilling rig 18. The wireless transceiver 44 associated with the top drive 46 may make electrical and/or optical connection to the communication channel in the drill string 10. Signals from the various sensors in the drill string 10 may be communicated over the signal channel in the drill string 10 to the corresponding wireless transceiver 44. Ultimately, such signals are communicated to the recording unit 40 for decoding and interpretation.

During drilling of the wellbore 16, fluid 32 is lifted from a tank or pit 30 using a pump 28. The discharge side of the pump 28 may be connected to a standpipe 24. The standpipe 24 may be coupled to the top drive 46 using a hose 26 or similar flexible conduit. During drilling, the top drive 46 may provide rotational motion to the drill string 10. Part of the weight of the drill string 10 maybe transferred to the drill bit 14 by the rig operator controlling the drawworks 22 so that the drill line 19 moves through the sheaves 20 causes the top drive 46 to move downwardly until the drill bit 14 contacts the bottom of the wellbore 16. The drill line 19 is extended further until a selected portion of the weight of the drill string 10 is applied to the drill bit 14.

The fluid 32 is moved under pressure exerted by the pump 28 ultimately through an interior passage in the drill string 10. The fluid 32 may exit the interior of the drill string 10 through nozzles or jets (not shown) in the drill bit 14. The discharged fluid serves to lubricate and cool the drill bit 14, and to lift drill cuttings created by the drill bit 14 to the surface. The fluid 32 may, during the drilling procedure, have its rheological properties changed and/or its composition changed, such that in combination with operating certain devices on the drill string 10 as will be further explained below, certain of the subsurface formations may have fractures 48 opened therein. The fractures 48 may be held open after creation and propagation thereof by fluid additive called "proppant." Alternatively, a second tank 30A may be filled with a different fluid 32A. When a suitable control command is generated by the recording system 40, a switching valve 31 may couple the intake of the pump 28 to the second tank 30A so as to pump the second fluid 32A through the drill string 10. The second fluid 32A may have composition and rheological properties particularly suited to creating and propping fractures (e.g., 48 in FIG. 1). The fluid 32 in the first mentioned tank may, on the other hand, have composition and rheological properties particularly suited for wellbore drilling. Another example of a system device for changing fluid composition will be further explained with reference to FIG. 3.

It is within the scope of this invention that the fluid 32 may be pumped through the drill string 10, through the drill bit 14 and into an annular space between the drill string 10 and the wellbore 16 to produce fractures 48. In some examples of a system that uses wired drill pipe, the lower end of the drill string 10 may include components, including the inflatable packer 34 and other devices, explained below with reference to FIG. 2, that will facilitate fracturing operations without removing the drill string 10 from the wellbore 16.

Figure 2:
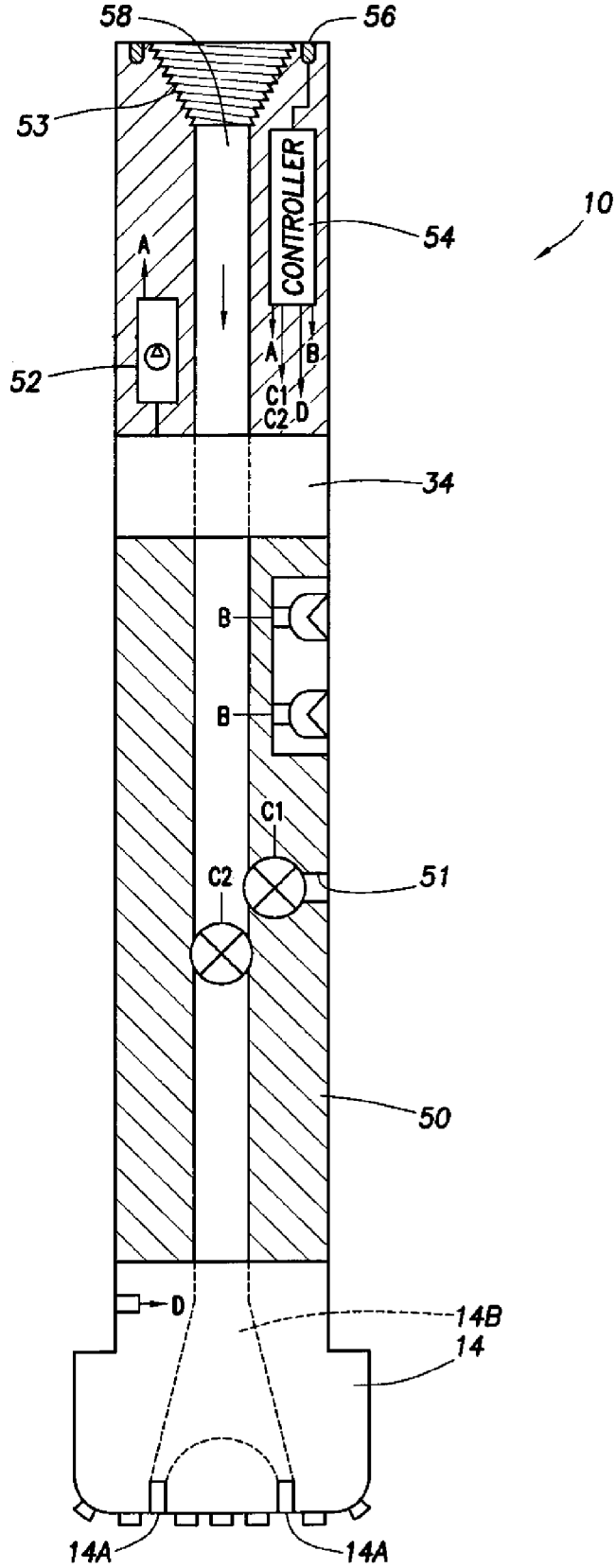
FIG. 2 shows an example of components near a lower end of a drill string that can be used for fracturing while drilling.

Referring to FIG. 2, the lower end of the drill string 10 may include a specialized drill collar 50 disposed therein above the drill bit 14. The drill bit 14 may include internal passages 14B coupled to nozzles or jets 14A for discharge of fluid during drilling and fracturing as explained above with reference to FIG. 1. The collar 50 may include electrically operated valves C1, C2 that when suitably actuated may stop passage of fluid through the drill string 10 and out through the drill bit 14, and may selectively divert fluid flow through a port 51 in the wall of the collar 50 into the annular space between the drill string 10 and the wellbore (16 in FIG. 1). A pressure and/or temperature sensor D may be arranged in a lower portion of the drill string to measure pressure and/or temperature in the annular space. An upper portion of the collar 50 may include therein a pump 52 that is operable to inflate and deflate the packer 34. The pump 52 may have its intake coupled to the annular space, or to the interior of the drill string 10 so that the pump 52 intake will be referenced to hydrostatic pressure in the wellbore (16 in FIG. 1). An upper end of the collar 50 may include a threaded connection 53 configured to mate with a corresponding threaded connection (not shown in FIG. 2) in the drill string. In the present example, an electromagnetic power and signal communication device 56 may be disposed in a suitable recess in a shoulder of the threaded connection 53. Configuration and operation of the communication device 56 may be, for example, substantially as explained in the Madhavan et al. '926 patent application publication referred to above.

The collar 50 may include a controller 54, such as a microprocessor based controller (including suitable device drivers) that can decode commands transmitted over the wired drill pipe and communicated through the communication device 56. Upon detection of the appropriate commands, the controller 54 generates control signals to operate the pump 52 and/or the valves C1, C2. The controller 54 may also receive signals from the sensor D and communicate such signals over the communication device 56 for detection and interpretation in the recording unit (40 in FIG. 1) as explained above with reference to FIG. 1.

The collar 50 may include one or more shaped explosive charges B configured to be electrically or otherwise initiated upon a suitable control signal being generated by the controller 54. Typically, the controller 54 may in some examples generate such signal upon receipt from the recording unit of a suitable command. In some examples, one or more shaped charges B may be detonated to create a perforation tunnel in the formations surrounding the wellbore (16 in FIG. 1) so that a fracture may be initiated more readily than by pumping fluid alone.

In one example of fracturing while drilling, when a suitable subsurface formation is identified, such as by receipt in the recording unit (40 in FIG. 1) of measurements from the LWD sensor (38 in FIG. 1) the system operator may stop downward motion of the drill string 10 by controlling the drawworks (22 in FIG. 1). The operator may also stop rotation of the drill string 10. In some examples, the operator may operate the drawworks (22 in FIG. 1) to lift the drill string 10 so that the bit is removed from the bottom of the wellbore. The operator may then enter suitable commands into a control panel (not shown) in the recording system (40 in FIG. 1) for communication to the collar 50. When the commands are detected by the controller 54, the valves C1, C2 may be operated to divert fluid flow into the annular space and the packer 34 may be inflated by operation of the pump 52 to seal the annular space. One or more of the shaped charges B may be detonated in some examples. Fluid may then be pumped through the drill string and into the sealed annular space. During pumping of the fluid, the pressure and/or temperature in the annular space may be measured by the sensor D and measurements therefrom may be transmitted to the recording unit (40 in FIG. 1). When the system operator observes a suitable indication of pressure and/or temperature indicative of successful creation of a facture (e.g., 48 in FIG. 1), the operator may then enter suitable commands to reconfigure the collar 50 to resume drilling operations.

It should be understood that the locations of the various components of the collar 50 shown in FIG. 2 are only one example of possible configurations of various components that may be used in a fracturing while drilling system according to the invention. In other examples, different fluid flow control devices and/or sensors may be used or omitted. Other examples may include more than one packer, or may omit the packer 34. A particular advantage that may be obtained using a system as shown in FIG. 2 is having a sensor the measurements from which may be received and used by the system operator substantially in real time. As will be readily appreciated by those skilled in the art, when pumping fluid to create and/or propagate fractures in subsurface formations, measurement of pressure, preferably at the conditions that exist proximate the formation being fractured, is important to determine the progress of fracture propagation. For example, controlling "tip screenout" in a fracturing operation is materially improved by having real time pressure measurements.

In another example, fracturing a formation may be performed by inflating the packer 34 to seal the annular space, and fluid may be pumped into the annular space between the drill string and the wellbore (16 in FIG. 1). In such examples, it may be advantageous to locate a pressure and/or temperature sensor D above the packer 34 so that pressure of the fracturing fluid may be measured during the pumping thereof In some examples, as the wellbore is drilled and sequentially more fractures are generated, the fractures may be distributed along the length of the wellbore, and not just in a single section of the wellbore. In such examples, a description of the rock characteristics, the in-situ stresses and/or the fluid pressure in the pore spaces of the various formations may be used to provide for planning and/or controlling the distribution of the fractures (48 in FIG. 1). Processing and characterization of an induced stress diversion ("ISD") effect, how new fractures form and propagate close to existing fractures, may also provide a technique for controlling the drilling and fracturing to provide a selected distribution of the fractures thus created. In some examples, the controller 54 or the like may provide for real time management of the fracturing with feedback and outputs provided. For example, the controller 54 may be programmed to respond to pressure measurements from the sensor D to automatically control the packer inflation and to control the valves C1, C2 so that fractures initiate and propagate according to a predetermined pattern.

In one example, drilling fluid circulation rates in the wellbore may be controlled to provide a pressure in the wellbore a selected amount above or below the fracture pressure of the particular formation. In some examples, the fracture pressure may be determined by measurements made by the LWD sensor (38 in FIG. 1), for example acoustic compressional and shear velocity and density. By appropriately controlling the circulation of the fluid, for example, by controlling the speed of the pump (28 in FIG. 1), suitable fluid pressure in the wellbore may be produced thus providing simultaneous or substantially simultaneous drilling and fracturing. Further, by controlling the circulation and/or pressure developed by the fluid used in the wellbore during the drilling process, a particular formation or a section of the formation surrounding the wellbore may be fractured at the same time the wellbore is drilled.

In some examples, a processor (not shown separately), such as may be disposed in the recording unit (40 in FIG. 1) may be configured to operate the pump (28 in FIG. 1) and/or the switching valve (31 in FIG. 1) to automatically control the fluid flow rate and the fluid used for fracturing at the same time as drilling. The processor may manage the fracturing and or drilling processes. In certain aspects, the sensor D in the drill string 10 and/or other sensors disposed in the relevant subsurface formations may provide feedback/information data to the processor (not shown) for suitable control of the fluid and pump rate.

In some examples certain parameters of the drilling of the wellbore may be changed, for example, depth, inclination, azimuthal orientation of the drilling, in response to the fracturing and/or results of the fracturing of the formation as the wellbore is drilled.

In some examples a fluid tagged with a tracer, such as a radioactive tracer, may provide for tracking the fracture inside or outside of the wellbore using a detector, such as a gamma ray detector or the like. Such detector may form part of the LWD sensor (38 in FIG. 1). In such examples if it is found from measurements made by the detector that the fracture is not propagating along a selected direction, that the fracture is propagating on top of a previously created fracture and/or the like, such improper fracture propagation may be corrected by automatically pumping a diverting agent, drilling further, drilling in a different direction and/or the like.

In a fracturing while drilling process, the first fracture made may initiate along the wellbore at the location of the lowest principal stress and lowest rock strength. The first fracture may be initiated and pumped as explained above. As the drilling process continues, and a next fracture location is penetrated by the drill bit 14, the fracturing process can be re-initiated. To ensure that the second and any subsequent fracture will not propagate to the original fracture location or any other fracture location, in one example the first and/or any prior created fracture may be overstressed. Overstressing may occur, for example, if the fracture is propped open by proppant. The wider the propped fracture, the higher the localized increased stress will occur. Propping of the fracture may be controlled to provide for controlled overstressing. The spacing of the fractures may be affected not only by fracture width but also fracture length, and the fractures may be placed so that new fractures will initiate in a location where they are no longer subjected to the increased stress maintained in the previous fracture.

In some examples, a tip screenout treatment may be performed in the first fracture that may substantially increase facture width and therefore the localized stress. To ensure that tip screenout ("TSO") is achieved, the fluid (32A in FIG. 1) may include certain types of fibers therein. In some examples, soluble or degradable fibers may be heavily loaded towards the end of the fracture fluid pumped for any one instance of fracturing at relatively high concentrations to help initiate a screenout. Such fiber concentration may provide for stabilizing the proppant and also temporarily reducing the overall proppant fluid permeability. Using a system as explained with reference to FIG. 1 and FIG. 2, the foregoing process may be repeated any selected number of times without having to remove the drill string 10 from the wellbore (16 in FIG. 1).

In some examples, pumping a concentrated slug of material called a "pill", such as a diversion pill, including of polylactic acid fibers, may be used to create temporary, but very low permeability filter cakes on the wall of the wellbore adjacent to permeable subsurface formations. Graded calcium carbonate may also be combined with polymer to create a similar pill. In some examples drilling fluid and/or the like may include fibers or some other fluid loss type material to minimize internal filtercake damage to the proppant pack. Alternatively, a proppant pack that is not permeable initially, similar to a WARP fluid, may be used in an aspect if the present invention.

In certain examples, to create a proppant "pack" that is originally highly damaged damaging (has relatively low near wellbore permeability to control fluid loss into the fractured formation) but ultimately becomes permeable after a preselected time, certain materials may be added to the proppant pack that are sized to fit inside the porosity of the proppant. Such materials may consist in part of particles that may be disposed in the pore spaces between proppant particles and subsequently easily and completely removed. A second size of plugging material, which fits inside the remaining porosity, may be added to this mixture that further reduces the permeability of the proppant. Merely by way of example, materials such as polylactic acid, polyglycolic acid and polyvinyl alcohol may be placed in the proppant in the form of solids, however such materials that hydrolyze over a known lime at known temperatures to revert to liquids. Other materials, such as grain size selected calcium carbonate, may be used and may be dissolved when required by an acid or the like. Waxes may be used in the proppant pack to provide for a solid material that may be fused at a given temperature into a liquid.

In other examples, temporarily reducing or altering the proppant pack permeability may include pumping soft compressible materials of a size that is slightly larger than the proppant pore throat size into the fractures. The compressible material may deform and fully plug the available pore volume upon closure. Again, as described above, this material may be removable at a later time.

In some examples minimization of flow through the fracture after creation and during drilling may be provided by placing an effective impermeable membrane ("filtercake") across the opening of the fracture along the wellbore. Such filtercake may be configured to quickly form as fluid is squeezed into the fracture itself. To minimize fluid damage from deep penetration of solid particles into the fracture, a robust filter cake may be plastered across the face of the fracture using jetting or the like.

In some examples the drilling may comprise air, nitrogen and/or the like for the fluid used during drilling. Merely by way of example, drilling with air or the like may be combined with fracturing using a water based fluid, a foam, pure nitrogen and/or the like. In such an example, production of water and gas from the formations while drilling continues may help with the "clean up" (removal of permeability reducing materials from the formations).

In some examples the drilling may be underbalanced (having hydrostatic pressure below the fluid pressure in the formation pore spaces) and the wellbore being drilled may be producing fluid while the fracturing while drilling is underway. In some examples, the fracturing while drilling may comprise drilling with on or more fracturing fluids. In other examples, or in combination with the foregoing, wellbore strengthening processes, including wellbore plastering, wellbore plastering while "casing drilling" and the like may be used in the method according to various aspects of the invention. Casing drilling is described, for example in U.S. Pat. No. 6,705,413 issued to Tessari.

In some examples, the fluid used to create the fractures (48 in FIG. 1) may contain esters, solvents, acids, that may help remove the near wellbore damage caused by the fluid used to drill the wellbore which may include "plugging" agents. As mentioned previously, acid soluble fibers and filtercake additives comprising sized calcium carbonates, mixed polylactic acid, carbonates and/or the like may be used at the tail end of the fracturing treatment to seal the fracture. Clean drilling fluid may be pumped down the drill pipe to protect the lower portions of the drill string 10 and proppant loaded fracturing fluid may be pumped down the annular space.

An example of an automated fracturing while drilling system that may perform any or all of the foregoing procedures will now be explained with reference to FIG. 3. The system may include a central processor ("CPU") 140 such as may be disposed in the recording unit 40. The CPU 140 may be a programmable computer including programming instructions operable to cause the CPU 140 to generate command signals for transmission over the wired drill pipe communication channel (FIGS. 1 and 2). The CPU 140 may also generate control signals to operate one of a plurality of fluid pumps P1, P2, P3 each of which may be coupled through a respective one-way (check) or other valve V1, V2, V3 to the fluid intake of the top drive 46 (see standpipe 24 and hose 26 in FIG. 1). As explained with reference to FIG. 1, the CPU 140 may communicate with the wired drill pipe communication channel using wireless transceivers 42, 44.

The CPU 140 may also generate command signals to operate various components in the collar (50 in FIG. 2), for example, the pump 52 to inflate the packer 34, and valves C1, C2 arranged to divert and/or stop fluid flow through the drill string (10 in FIG. 2). Such command signals may be decoded and acted upon by the controller 54 in the collar (50 in FIG. 2). In the system shown in FIG. 3, drilling operations may be performed as explained above with reference to FIG. 1. During such drilling operations, fluid, for example F1, which may be drilling mud, may be pumped from the respective tank by a respective pump P1 to perform the functions explained above for the fluid during drilling. Measurements from sensors in or associated with the collar (50 in FIG. 2), for example, the LWD sensors (38 in FIG. 1) may be transmitted to the CPU 140 over the wired drill pipe communication channel. Instructions in the CPU 140 may, in response to certain measurements from the sensors, cause pump P1 to stop or slow, and may cause one ort more of pumps P2 and P3 to operate so as to discharge fracturing fluid into the drill string. Example compositions of fracturing fluid and/or filtercake producing fluid are explained above. The particular pumps operated and the rates of operation may be determined by the instructions stored in the CPU 140. Such instructions may provide for certain fluid flow rates and pressures in response to formation characteristics determined by measurements from the various LWD sensors (38 in FIG. 1). If the CPU 140 initiates pumping fracturing fluid, the CPU 140 may also transmit commands to the collar (50 in FIG. 2) to be received and decoded in the controller 54. The controller 54 may include programming instructions to operate various devices in the collar, for example, the diverter and the packer inflation pump 52. The controller 54, as previously explained may also include instructions to cause operation of the various components in the collar based on measurements of a parameter in the annular space, for example, pressure or temperature.

Figure 3:
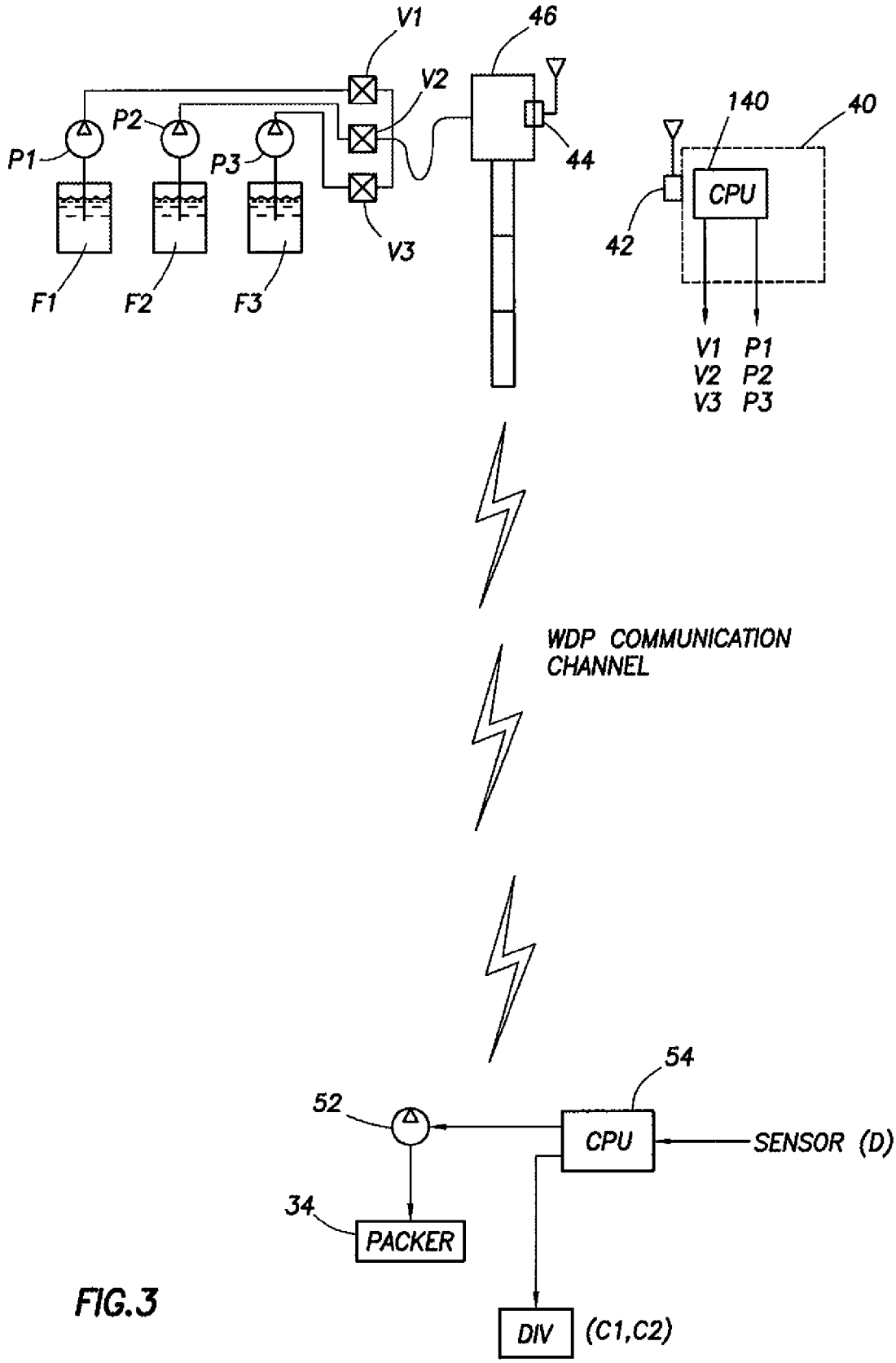
FIG. 3 shows an example of an automated fracturing while drilling system.

Using a device as shown in FIG. 3, the various fracturing while drilling procedures explained above may be performed automatically. Automatic operation of fracturing while drilling may reduce the possibility of fracture failure due to operator error, and may increase safety of the fracturing while drilling operation. By controlling the fracturing while drilling process based on substantially real time measurements of a wellbore parameter (e.g., pressure and/or temperature) chances of fracture job failure due to data delay may be reduced.

While the invention has been described with respect to a limited number of examples, those skilled in the art, having benefit of this disclosure, will appreciate that other examples can be devised which do not depart from the scope of the invention as disclosed herein. Accordingly, the scope of the invention should be limited only by the attached claims.

What is claimed is:

1. A method, comprising:

fracturing a wellbore using a drill string, including the steps of:

inserting the drill string into a wellbore;

pumping a fluid into at least one of an interior passage in the drill string and an annular space between a wall of the wellbore and the drill string;

measuring at least one of a pressure and a temperature of the fluid proximate a lower end of the drill string;

transmitting the measurements to the surface substantially contemporaneously with the measuring; and transmitting control signals from a controller in a drill string to perform at least one of the following: inflating a packer, deflating a packer, diverting fluid flow, and initiating shaped charges.

2. The method of claim 1 further comprising selectively sealing the annular space.

3. The method of claim 1 wherein the pumped fluid is discharged through a drill bit.

4. The method of claim 1 further comprising diverting flow of fluid into the annular space.

5. The method of claim 1 wherein the pumping fluid, measuring, transmitting and controlling are performed contemporaneously with drilling a subsurface formation in the wellbore.

6. The method of claim 1 wherein the transmitting comprises communicating over a communication channel in a wired drill pipe string.

7. The method of claim 1 wherein the fluid comprises proppant.

8. The method of claim 7 wherein the proppant comprises a material selected to reduce permeability of a fracture for a selected time after creation thereof to enable further drilling of the wellbore.

9. The method of claim 1 further comprising changing the fluid from a first fluid used for drilling the wellbore to a second fluid used to open and maintain fractures.

10. The method of claim 1 further comprising controlling at least one of pressure and flow rate automatically in response to the measurements.

* * * * *